US010589281B2

(12) United States Patent
Edet et al.

(10) Patent No.: US 10,589,281 B2
(45) Date of Patent: Mar. 17, 2020

(54) MILL FOR CRUSHING A BED OF MATERIALS BY COMPRESSION

(71) Applicant: FIVES FCB, Villeneuve d'Ascq (FR)

(72) Inventors: Eric Edet, Villeneuve d'Ascq (FR); Alain Cordonnier, Villeneuve d'Ascq (FR)

(73) Assignee: FIVES FCB, Villeneuve d'Ascq (FR)

( * ) Notice: Subject to any disclaimer, the term of this patent is extended or adjusted under 35 U.S.C. 154(b) by 237 days.

(21) Appl. No.: 15/517,598

(22) PCT Filed: Oct. 7, 2015

(86) PCT No.: PCT/FR2015/052691

§ 371 (c)(1),
(2) Date: Apr. 7, 2017

(87) PCT Pub. No.: WO2016/055734

PCT Pub. Date: Apr. 14, 2016

(65) Prior Publication Data

US 2017/0304834 A1 Oct. 26, 2017

(30) Foreign Application Priority Data

Oct. 10, 2014 (FR) ..... 14 59719

(51) Int. Cl.
*B02C 15/06* (2006.01)
*B02C 15/00* (2006.01)

(52) U.S. Cl.
CPC ..... *B02C 15/06* (2013.01); *B02C 15/003* (2013.01); *B02C 2210/02* (2013.01)

(58) Field of Classification Search
CPC ... B02C 15/06; B02C 15/003; B02C 2210/02; B02C 15/00; B02C 15/02
See application file for complete search history.

(56) References Cited

U.S. PATENT DOCUMENTS 5,205,494 A 4/1993 Durinck et al.
6,138,933 A 10/2000 Chevalier et al.
7,866,584 B2 * 1/2011 Guerrero Palma ... B02C 15/004 241/117

FOREIGN PATENT DOCUMENTS

DE 10 55 926 B 4/1959
EP 0 486 371 A 5/1992
(Continued)

OTHER PUBLICATIONS

International Search Report, dated Jan. 25, 2016, from corresponding PCT application.
(Continued)

*Primary Examiner* — Omar Flores Sanchez
(74) *Attorney, Agent, or Firm* — Young & Thompson

(57) ABSTRACT

A mill for crushing a bed of materials by compression includes: a horizontal-axis cylinder the interior wall having a runway track for a crushing roller placed inside the cylinder, a unit rotating the cylinder at a speed that spins the material outward, the crushing roller, a unit for pressing the crushing roller against the runway track of the cylinder, an inlet for supplying material for crushing at one end of the cylinder and an outlet for crushed material at the other end, a unit for controlling the movement of the material so it travels over only a fraction of the length of the cylinder in each revolution and passes between the cylinder and the roller several times before reaching the outlet. The runway track is followed by a downstream lip opposing material flow, downstream of the crushing roller in the direction in which the material travels.

19 Claims, 3 Drawing Sheets

(56) References Cited

FOREIGN PATENT DOCUMENTS

| | | | |
|---|---|---|---|
| EP | 0 934 120 | A1 | 8/1999 |
| FR | 2 742 078 | A1 | 6/1997 |
| GB | 2 246 720 | A | 2/1992 |
| JP | S61-42348 | A | 2/1986 |
| JP | S62-187635 | U | 11/1987 |
| JP | H06-091188 | A | 4/1994 |
| JP | H09-500832 | A | 1/1997 |
| JP | H11-508484 | A | 7/1999 |
| JP | 2001-518841 | A | 10/2001 |
| WO | 95/03888 | A1 | 2/1995 |
| WO | 97/02093 | A1 | 1/1997 |
| WO | 98/46355 | A1 | 10/1998 |
| WO | 98/46357 | A1 | 10/1998 |

OTHER PUBLICATIONS

Office Action in Japanese Patent Application No. 2017-518917 dated Jul. 12, 2019 with English translation provided.

* cited by examiner

MILL FOR CRUSHING A BED OF MATERIALS BY COMPRESSION

The invention relates to a mill for crushing a bed of materials by compression, usually named horizontal roller mill, and has particular application in the crushing of mineral materials, not limitingly, for the manufacture of cement clinker.

Documents EP 0 486 371 and EP 0 934 120 describe such a type of mill that comprises a cylinder rotating about its horizontal axis, and of which the interior wall, usually covered with a layer of wear material, forms a runway track for a crushing roller, with an axis of rotation substantially parallel to the axis of the cylinder, and applied under high pressure to the runway track. The material for crushing is supplied in the cylinder, at one of its ends, and exits at the other end. In such a mill, the driving speed of the cylinder is such that the material is spun outward against the runway track, maintained against the track during the rotation of the cylinder, with the material passing several times between the runway track and the crushing roller. It is known to control the number of passages using mechanical devices. Such devices are described in document EP 0 934 120, and can comprise a set of deflecting scraper/plates(s). The scraper is placed inside the cylinder, in the descending upper portion, and arranged to detach the material from the runway track. One or several deflector plates are placed in such a way as to intercept the material detached by the scraper and deviate it in the direction of the outlet of the mill.

The material for crushing that is supplied in the mill has a rough granulometry, with a maximum grain size that can typically reach 100 mm. Through the effect of the operation of handling systems, the flow rate of materials is subject to fluctuations, and the granulometric distribution is also subject to fluctuations. This induces variations in the constitution and in the thickness of the bed of materials and variations in the forces exerted by the crushing roller which results in vibrations of the machine. These vibrations create mechanical stresses that participate in the reduction of the service life of the constituents of the machine, even of the elements in the vicinity of the crushing workshop.

In such a type of mill the material advances from one end of the machine to the other, at the same time as it is subjected to the successive crushing actions. As such the granulometry of the material is rougher in the portion of the mill located near the inlet end, than in the portion of the mill located near the outlet end. The bed of materials therefore has a behaviour that varies all along the mill, and the crushing roller is stressed differently at the various points of its length. In particular, the finer material located close to the outlet end tends to flow in front of the crushing roller, escaping from the hold of the crushing roller. This phenomenon produces a thin bed of materials and disturbs the proper spinning outward of the material. This unbalances the machine, decreases the effectiveness of it, increases sensitivity to vibrations and leads to dissymmetric wear.

When the raw materials supplied in the mill contain a substantial proportion of fine particles, the escape phenomenon can also exist in the vicinity of the upstream end of the roller, cause a material reflux, and be at the origin of other instability problems.

The purpose of this invention is to overcome the aforementioned disadvantages by proposing a mill that makes it possible to guarantee a sufficient thickness of the bed of materials on the side where the materials are the thinnest.

Another purpose of this invention, at least according to one embodiment, is to propose such a mill of which the manufacture is not complicated with respect to prior art.

Other purposes and advantages of the invention shall appear in the following description which is provided only for the purposes of information and does not have for purpose to limit it.

Also the invention relates to a mill for crushing a bed of materials by compression comprising:

a horizontal-axis cylinder of which the interior wall is provided with a runway track for a crushing roller, placed inside said cylinder, means for driving the cylinder in rotation about its axis at a speed that spins the material outward, said crushing roller, means for pressing said crushing roller against the runway track of said cylinder, an inlet for supplying material for crushing situated at one of the ends of the cylinder and an outlet for crushed material at the other end of said cylinder, means for controlling the movement of the material so that it travels over only a fraction of the length of the cylinder in each revolution and passes between the cylinder and the roller several times before reaching the outlet.

According to the invention, the runway track is followed by a downstream lip, intended to oppose the flow of the material, located downstream of said crushing roller according to the direction of displacement of the material, said downstream lip comprising several elements placed according to an interior perimeter of said cylinder.

According to optional characteristics of the invention, taken separately or in combination:

all of the elements forming the downstream lip occupy at least 75% of the interior perimeter of the cylinder;

the height of the elements forming the downstream lip and exceeding the runway track is between 1% and 5% of the diameter of the crushing roller;

the distance between the downstream end of the crushing roller and the downstream lip is between 1.5% and 7.5% of the diameter of the crushing roller;

the runway track is preceded by a lip, opposing the flow of the material, located upstream of said crushing roller according to the direction of displacement of the material, said lip comprising several elements placed according to an interior perimeter of said cylinder;

all of the elements forming the upstream lip occupy at least 75% of the interior perimeter of the cylinder;

the height of the elements forming the upstream lip and exceeding the runway track is between 100% and 150% of the height of the elements forming the downstream lip, exceeding said runway track;

the distance between the upstream end of the crushing roller and the upstream lip is between 1.5% and 7.5% of the diameter of the crushing roller;

the runway track is devoid of an upstream lip that opposes the flow of the material;

the downstream lip on the interior perimeter of the cylinder is a discontinuous lip, said elements being distributed over the interior perimeter, mutually spaced apart, creating a plurality of passages on the interior perimeter;

the upstream lip on the interior perimeter of the cylinder is a discontinuous lip, said elements being distributed over the interior perimeter, mutually spaced apart, creating a plurality of passages on the interior perimeter;

said means for controlling the movement of the material so that it travels over only a fraction of the length of the cylinder in each revolution and passes between the cylinder and the roller several times before reaching the outlet include at least one scraper placed inside the cylinder, in the descending upper portion, able to detach the material from the runway track and one, or preferably several deflector plates placed under the scraper in such a way as to intercept the material detached by the scraper and deviate it in the direction of the outlet of the mill.

According to an embodiment, the runway track comprises a layer of hard material, of wear, added onto the interior wall of said cylinder, formed by a plurality of wear plates and wherein the elements forming the downstream lip are added elements and respectively integral with the wear plates. According to another alternative, the elements forming the downstream lip are each constituted by the hard material of the wear plates, said elements being respectively of a single piece with said wear plates.

According to an embodiment, the runway track is formed by a layer of hard material, of wear, added onto the interior wall of said cylinder, formed by a plurality of wear plates and wherein the elements forming the upstream lip are added elements and respectively integral with the wear plates. According to another alternative, the elements forming the upstream lip are each constituted by the hard material of the wear plates, said elements being respectively of a single piece with said wear plates.

The invention shall be better understood when reading the following description accompanied with annexed drawings among which:

Figure 1:
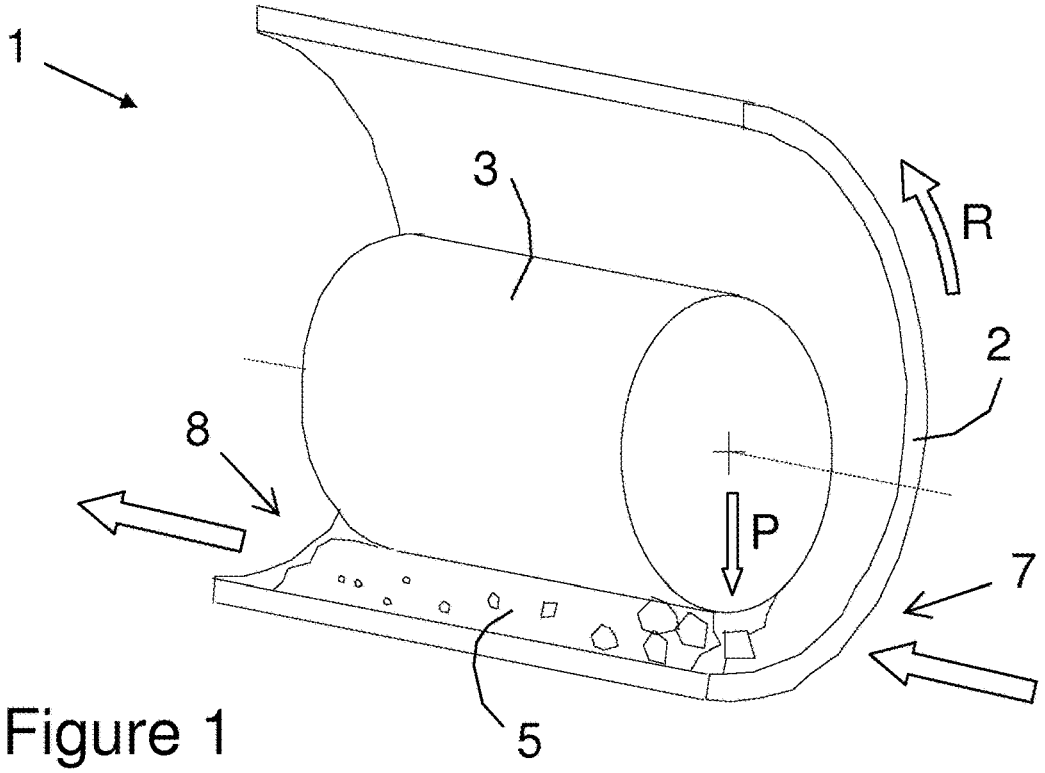
FIG. 1 shows the operating principle of a horizontal mill for crushing the bed of materials by compression (downstream lip not shown).

The invention relates to a mill 1 for crushing a bed of materials by compression comprising:

a horizontal-axis A cylinder 2 of which the interior wall is provided with a runway track for a crushing roller 3, placed inside said cylinder, means for driving the cylinder in rotation about its axis at a speed that spins the material outward, said crushing roller 3, means for pressing said crushing roller 3 against the runway track of said cylinder, an inlet 7 for the supply of the material for crushing situated at one of the ends of the cylinder and an outlet 8 for the crushed material at the other end of said cylinder, means for controlling the movement of the material so that it travels over only a fraction of the length of the cylinder in each revolution and passes between the cylinder and the roller several times before reaching the outlet.

The horizontal-axis A cylinder 2 can be a ferrule, in particular made of metal, bearing against bearings (not shown) in particular hydrostatic the provide the guiding in rotation of the cylinder about its horizontal axis A. The runway track can be formed by a layer 6 of hard material, of wear, added onto the interior wall of said cylinder, formed by a plurality of wear plates 61. Said means for driving the cylinder in rotation about its axis A can include a geared motor of which the output axis has a pinion coupled to a ring gear, integral with the exterior wall of the cylinder 2. According to the invention, these means drive the cylinder 2 at a speed that provides the spinning outward of the material. In other terms, the speed of the cylinder 2 is such that the material is, under the effect of the centrifugal force, maintained against the runway track, during the rotation of the cylinder.

Said means for applying the crushing roller against the runway track can include arms that guide the ends of the crushing roller 3 by the intermediary of bearings, as well as cylinders or springs suitable for exerting a force on the ends of the crushing roller 3, and connected to said arms. According to an embodiment, said means for applying the crushing roller 3 against the runway track are such that the crushing roller exerts on the bed of materials an average pressure P between 10 MPa and 40 MPa. The crushing roller is of an axis substantially parallel to that of the axis of the cylinder.

The supply of the mill 1 is carried out at the inlet 7 at one of the ends of the cylinder 2, with the outlet 8 of the crushed materials being located at the other end of the cylinder. Between the inlet 7 and the outlet 8, the material passes several times between the runway track and the crushing roller 3, travelling over a fraction of the length of the cylinder in each revolution. The advancing of the materials in the cylinder is as such regulated by means that can comprise a device intended to ensure the advancing of the material, from one end to the other of the cylinder 2, and such that in particular those described in document EP 0 486 371 or EP 0 934 120.

Such a device comprises at least one scraper (or knife) 9 placed inside the cylinder, in the descending upper portion, as well as one or several deflector plate(s) 10, placed under the scraper 9. The scraper 9 makes it possible to detach the material from the runway track, which, otherwise, would be maintained against the track under the effect of the centrifugal force. The deflector plate 10 (or deflector plates) placed under the scraper 9 intercept the material detached by the latter and deviate it in the direction of the outlet of the mill.

Figure 2:
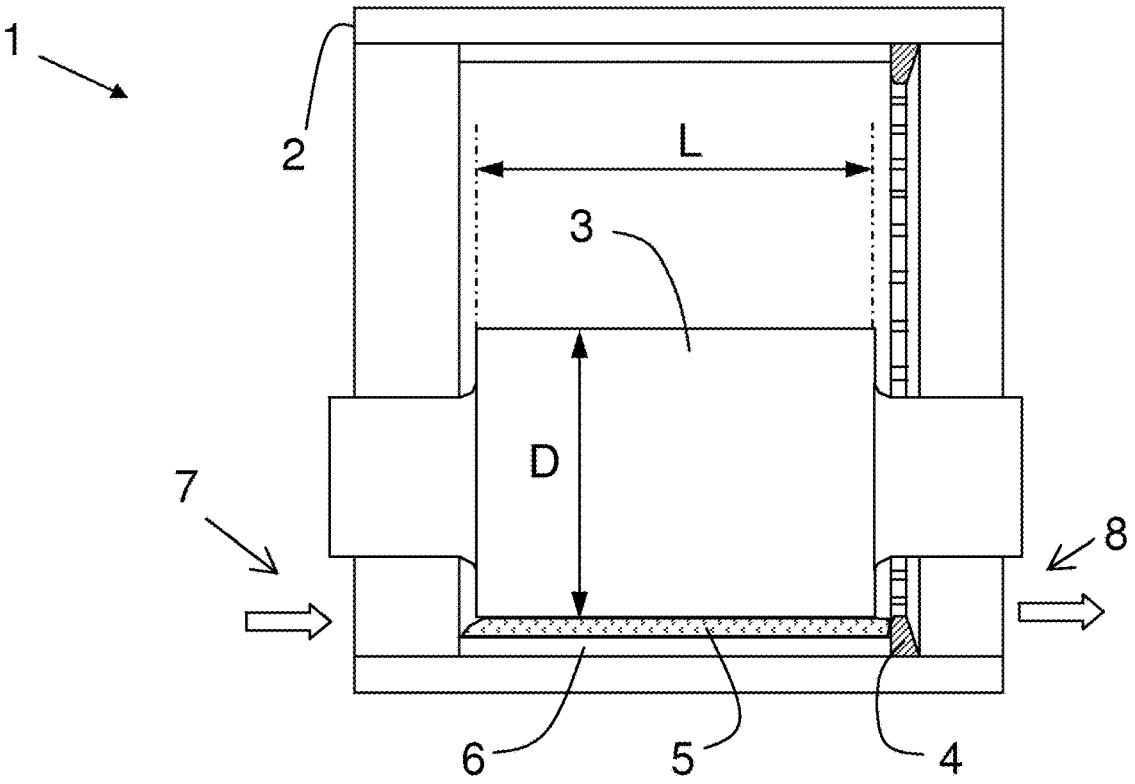
FIG. 2 is a vertical cross-section view along the axis of the cylinder, in accordance with the invention according to an embodiment, and having on the side of the outlet of the materials, along an interior perimeter of the cylinder, elements forming obstacles slowing down the removal of the material.

According to the invention, the runway track is followed by a downstream lip, intended to oppose the flow of the material, located downstream of said crushing roller according to the direction of displacement of the material. An embodiment of the mill provided with such a downstream lip is shown, as a non-limiting example, aux FIGS. 2, 3 and 4. The function of this downstream lip is to slow down the escaping of the material on the downstream end of the crushing roller 3, as such preventing the bed of materials on this end from being too thin, and as shown in detail in FIG. 4.

According to the invention, this downstream lip comprises several elements 4 placed according to an interior perimeter of said cylinder 2. All of the elements that form the downstream lip occupy, according to an embodiment, at least 75% of the interior perimeter of the cylinder 2. These elements 4 can be elements in the shape of an arc of a circle, in particular with a constant section over the length, and with a radius of curvature that in particular substantially corresponds to the cylinder (or to the runway track).

Figure 3:
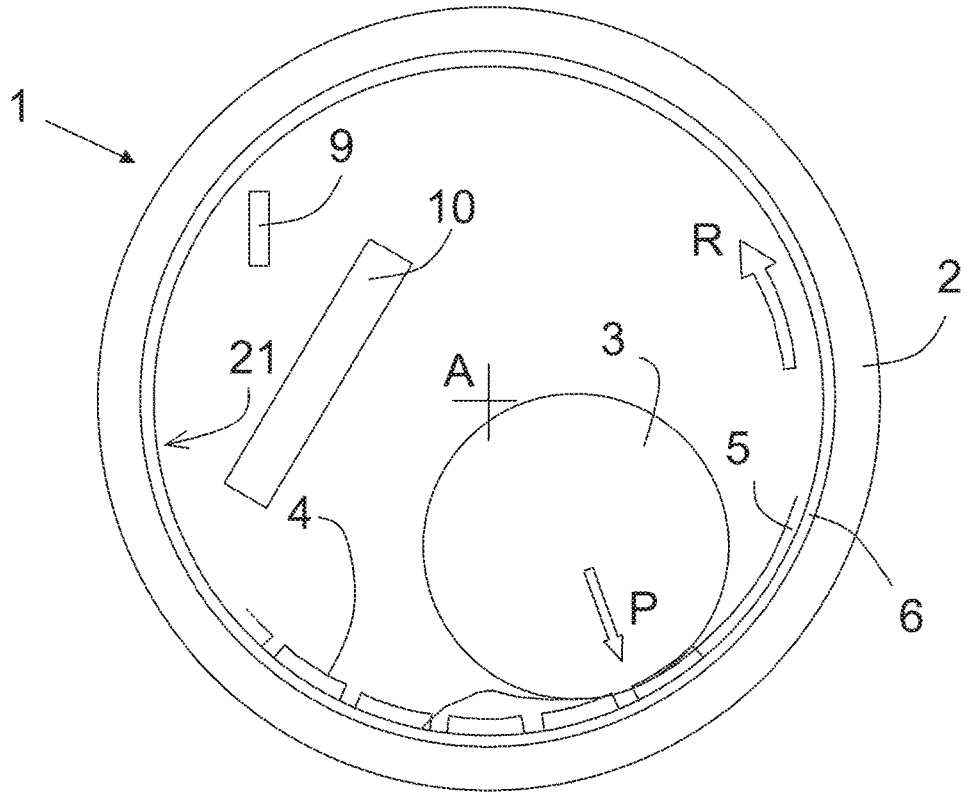
FIG. 3 is a view of the device of FIG. 2, along a cutting plane perpendicular to the axis of the cylinder.
Figure 4:
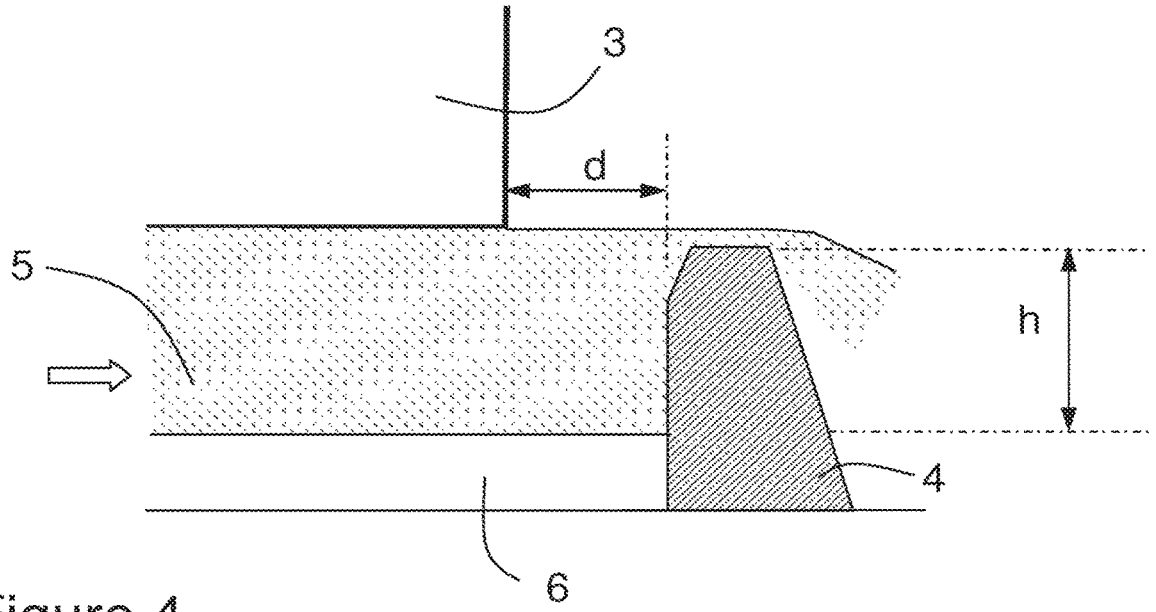
FIG. 4 is a detailed view of an element of the downstream lip, and of its positioning with respect to the runway track, as well as with respect to the downstream end of the crushing roller.

According to an alternative in particular shown in FIGS. 3 and 4, the downstream lip on the interior perimeter of the cylinder is a discontinuous lip. Said elements 4 can be distributed over an interior perimeter, mutually spaced apart, creating a plurality of passages on the interior perimeter. These various passages, constituted by the inter-spaces between elements 4, are distributed over the perimeter of the cylinder 2, and preferably regularly.

Generally, the removal of the material is obtained, either by the effect of an overflow of the material above the elements 4 of the downstream lip, or through passages between elements 4 (in the case of a discontinuous lip), or by the combination of the two effects.

According to an embodiment, the height h of the elements 4 that form the downstream lip and exceeding the runway track is between 1% and 5% of the diameter D of the crushing roller 3. The height h is shown in FIG. 4: this is the dimension of the element 4, starting from the surface of the runway track, and along a radial direction to the cylinder.

According to an embodiment, the distance d between the downstream end of the crushing roller 3 and the downstream lip is between 1.5% and 7.5% of the diameter D of the crushing roller 3. The distance d is shown in FIG. 4: this is the dimension, along the axial direction of the cylinder 2, between the downstream end of the crushing roller 3, and the downstream lip. The length L of the crushing roller 3 can be of a length less than the runway track.

The mill according to the invention is as such advantageously provided with a downstream lip intended to slow down the flow of the material, in the zone of the mill where the material is the finest, on the downstream end of the roller 3, in particular at the outlet 8 of the mill. Such a lip, at the other end of the runway track, i.e. upstream of the crushing roller, is however optional. As such, and according to an embodiment shown in a non-limiting manner in FIG. 2, the mill can be devoid of such a lip, upstream of the crushing roller 3.

Such an upstream lip can however be of interest in particular in the case where the material at the inlet of the mill has a substantial proportion of fine particles, and in such a way as to limit the escape and reflux phenomena on the upstream end of the crushing roller 3.

Figure 5:
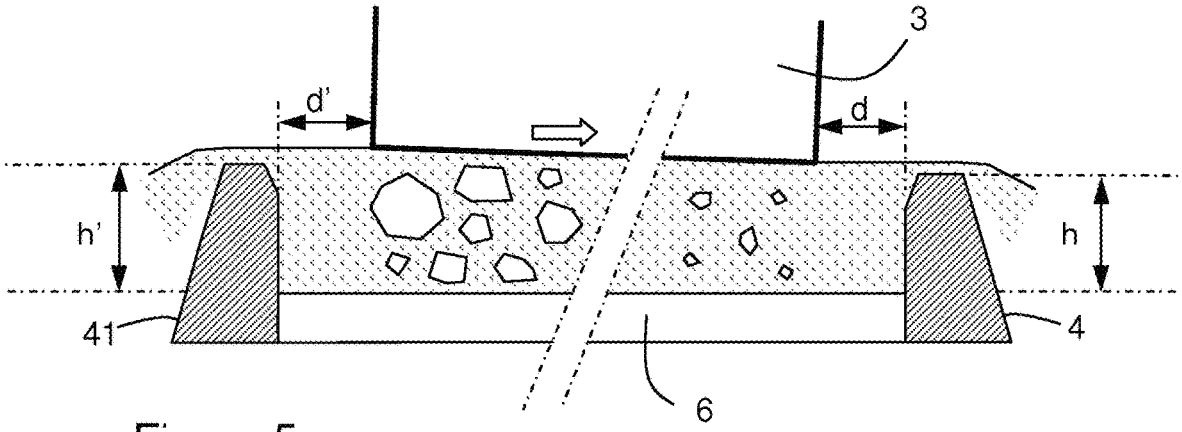
FIG. 5 shows a particular embodiment of the invention, presenting in addition to the downstream lip, intended to slow down the escape of the materials on the downstream end of the crushing roller, an upstream lip intended to slow down the escape of the materials on the upstream end of the crushing roller.

According to an embodiment, the runway track can be preceded by an upstream lip that opposes the flow of the material, in the reflux direction. The function of this upstream lip is to slow down the escaping of the material on the upstream end of the crushing roller 3, as such preventing the bed of materials on this end from being too thin, and as shown in detail in FIG. 5. This lip can include several elements 41 placed according to an interior perimeter of said cylinder 2.

All of the elements that form the upstream lip occupy, according to an embodiment, at least 75% of the interior perimeter of the cylinder 2. These elements 4 can have the form of elements in an arc of circle and a radius of curvature that corresponds in particular substantially to the cylinder or to the runway track.

According to an alternative, the upstream lip on the interior perimeter of the cylinder is a discontinuous lip. Said elements 41 are then distributed over an interior perimeter, mutually spaced apart, creating a plurality of passages on the interior perimeter. These various passages, formed by the inter-spaces between elements 4, are distributed over the perimeter of the cylinder 2, and preferably regularly over the perimeter of the cylinder.

According to an advantageous embodiment, the height h' of the elements 41 that form the upstream lip and that exceed the runway track is greater than the height h of the elements 4 that form the downstream lip, exceeding said runway track. For example the height h' of the elements 41 can be between 100% and 150% of the height h of the elements 4 that form the downstream lip. The distance between the upstream end of the crushing roller 3 and the upstream lip can be between 1.5% and 7.5% of the diameter D of the crushing roller.

Figure 6:
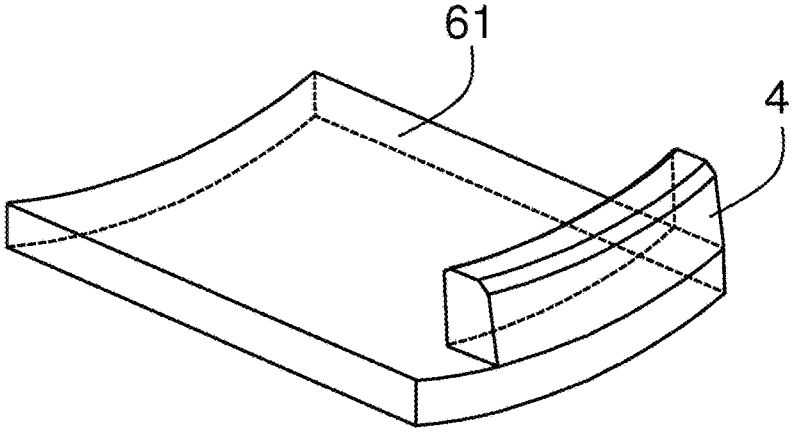
FIG. 6 shows a wear plate forming a portion of the protective layer of the cylinder and intended to be provided on the cylinder downstream of the runway track, with an element of the downstream lip and said wear plate being attached by the downstream end of said plate.

In the case where the runway track comprises a layer 6 of hard material, of wear, formed by a plurality of wear plates 61, the elements 4 that form the downstream lip can be elements that are added and integral respectively with the wear plates 61. Such a wear plate is shown, as a non-limiting example in FIG. 6. Each plate comprises an interior concave surface, intended to form a portion of the runway track, an exterior convex surface, intended to be fixed and applied to the interior wall of the cylinder and edges in particular for assembling, in particular in a number of four.

Each element 4 in particular in the shape of an arc of circle, is of a dimension less than said plate and is linked to said plate by any suitable means, such as glue, welding, mechanical fastening. The element 4 can be linked to the interior concave surface of the plate, on the downstream end of said wear plate. According to an alternative, the elements 4 that form the downstream lip are each constituted by the hard material of the wear plates 61, said elements 4 being respectively of a single piece with said wear plates 61.

In both cases, the elements 4 and the corresponding wear plates 61 form in pairs, respectively mechanical assemblies that will make it possible to carry out, simultaneously, the wear layer 6 and the downstream lip, during the assembly of the plates 61.

In the same way, the elements 41 forming the upstream lip can be elements that are added and integral respectively with wear plates 61. Each element 41 in particular in the shape of an arc of circle, is of a dimension less than said plate and is made integral with said plate by any suitable means, such as gluing, welding, mechanical fastening. The element 41 can be linked to the interior concave surface of the plate 61, on the upstream end of said wear plate 41. According to an alternative, the elements 41 that form the upstream lip are each constituted by the hard material of the wear plates 61, with said elements 41 being respectively of a single piece with said wear plates 61. In both cases, the elements 41 and the corresponding wear plates 61 form in pairs, respectively mechanical assemblies that will make it possible to carry out, simultaneously, the wear layer 6 and the downstream lip, during the assembly of the plates 61.

Naturally other embodiments could have been considered by those skilled in the art without however leaving the scope of the invention such as defined by the claims hereinafter.

NOMENCLATURE

1. Mill,
2. Cylinder,
3. Crushing roller,
4. Elements (downstream lip),
41. Elements (upstream lip),
61. Wear plate,
6. Layer of hard material
7. Inlet (mill),

8. Outlet (mill), d. Distance separating the crushing roller from the downstream lip, d'. Distance separating the crushing roller from the upstream lip, D. Diameter of the crushing roller, h. Height of the elements marked 4 of the downstream lip (in reference to the surface of the runway track), h'. Height of the elements marked 41 of the upstream lip (in reference to the surface of the runway track), A. Horizontal axis L. Length of the crushing roller P. Pressure

The invention claimed is:

1. A mill for crushing (1) a bed of material by compression, comprising:

a crushing roller (3);

a horizontal-axis (A) cylinder (2) with two opposing ends and an interior wall, the interior wall being provided with a runway track for the crushing roller (3), placed inside said cylinder;

driving means for driving the cylinder in rotation about the axis of the cylinder at a speed that spins the material outward;

pressing means for pressing said crushing roller against the runway track of said cylinder;

an inlet (7) for a supply of the material, situated at one of the two ends of the cylinder, and an outlet (8) for crushed material at the other of the two ends of said cylinder; and movement controlling means for controlling movement of the material so that the material travels over only a fraction of the length of the cylinder in each revolution and passes between the cylinder and the roller several times before reaching the outlet, said movement controlling means comprised of at least one scraper inside the cylinder, in a descending upper portion of the cylinder and configured to detach the material from the runway track, and a deflector plate under the scraper in such a way as to intercept material detached by the scraper and deviate the intercepted material toward the outlet, wherein the runway track is followed by a downstream lip, configured to oppose a flow of the material, the downstream lip located downstream of said crushing roller with respect to a direction of displacement of the material, said downstream lip comprising a plurality of elements (4) placed according to an interior perimeter of said cylinder (2).

2. The mill according to claim 1, wherein all the elements of the downstream lip occupy at least 75% of the interior perimeter of the cylinder.

3. The mill according to claim 1, wherein the height (h) of the elements of the downstream lip and that exceed the runway track is between 1% and 5% of the diameter (D) of the crushing roller.

4. The mill according to claim 1, wherein a distance (d) between a downstream end of the two ends of the crushing roller (3) and the downstream lip is between 1.5% and 7.5% of the diameter (D) of the crushing roller (3).

5. The mill according to claim 1, wherein the runway track is preceded by an upstream lip, opposing the flow of the material in a reflux direction, the upstream lip located upstream of said crushing roller with respect to the direction of displacement of the material, said upstream lip including upstream lip elements (41) placed according to the interior perimeter of said cylinder (2).

6. The mill according to claim 5, wherein all of the upstream lip elements (41) of the upstream lip occupy at least 75% of the interior perimeter of the cylinder.

7. The mill according to claim 5, wherein the height (h') of the upstream lip elements (41) of the upstream lip and that exceed the runway track is between 100% and 150% of the height (h) of the elements (4) of the downstream lip, exceeding said runway track.

8. The mill according to claim 5, wherein a distance (d') between an upstream end of the two ends of the crushing roller (3) and the upstream lip is between 1.5% and 7.5% of the diameter (D) of the crushing roller.

9. The mill according to claim 1, wherein the runway track is devoid of an upstream lip opposing the flow of the material.

10. The mill according to claim 1, wherein the runway track includes a layer (6) of hard material located on the interior wall of said cylinder (2), formed by a plurality of wear plates (61), and wherein the elements (4) of the downstream lip are added elements and respectively integral with the wear plates (61).

11. The mill according to claim 1, wherein the runway track includes a layer (6) of hard material located on the interior wall of said cylinder, formed by a plurality of wear plates (61), and wherein the elements (4) of the downstream lip are each constituted by the hard material of the wear plates (61), said elements (4) being respectively of a single piece with said wear plates (61).

12. The mill according to claim 5, wherein the runway track is formed by a layer of hard material (6) located on the interior wall of said cylinder (2), formed by a plurality of wear plates (61), and wherein the upstream lip elements (41) of the upstream lip are added elements and respectively integral with the wear plates.

13. The mill according to claim 5, wherein the runway track is formed by a layer of hard material located on the interior wall of said cylinder, formed by a plurality of wear plates (61), and wherein the upstream lip elements (41) of the upstream lip are each constituted by the hard material of the wear plates, said upstream lip elements (41) being respectively of a single piece with said wear plates (61).

14. The mill according to claim 1, wherein the downstream lip on the interior perimeter of the cylinder is a discontinuous lip, with said elements (4) being distributed over the interior perimeter, mutually spaced apart, forming a plurality of passages on the interior perimeter.

15. The mill according to claim 5, wherein the upstream lip on the interior perimeter of the cylinder is a discontinuous lip, with said upstream lip elements (41) being distributed over the interior perimeter, mutually spaced apart, creating a plurality of passages on the interior perimeter.

16. A method for the crushing of mineral material, comprising providing the mill of claim 1, supplying the mineral material to the mill, and crushing the mineral material using the mill.

17. The mill according to claim 2, wherein the height (h) of the elements of the downstream lip and that exceed the runway track is between 1% and 5% of the diameter (D) of the crushing roller.

18. The mill according to claim 2, wherein a distance (d) between a downstream end of the two ends of the crushing roller (3) and the downstream lip is between 1.5% and 7.5% of the diameter (D) of the crushing roller (3).

19. The mill according to claim 3, wherein a distance (d) between a downstream end of the two ends of the crushing roller (3) and the downstream lip is between 1.5% and 7.5% of the diameter (D) of the crushing roller (3).

* * * * *